United States Patent [19]

Knoke et al.

[11] 4,320,817

[45] Mar. 23, 1982

[54] COMBINED CHAIR AND STOOL APPARATUS

[75] Inventors: Silas J. Knoke, Seymour; James F. Stamper, Nashville, both of Ind.

[73] Assignee: Lear Siegler, Inc., Seymour, Ind.

[21] Appl. No.: 73,151

[22] Filed: Sep. 7, 1979

[51] Int. Cl.[3] ..... A47C 4/00; A47C 3/18; A47C 9/00

[52] U.S. Cl. ..... 182/126; 182/33; 297/59

[58] Field of Search ..... 182/124, 125, 126, 33, 182/161, 156; 16/172; 297/60, 59

[56] References Cited

U.S. PATENT DOCUMENTS

| | | | |
|---|---|---|---|
| 472,603 | 4/1892 | Hamilton | 297/60 |
| 1,162,237 | 11/1915 | Hipolito | 16/172 |
| 1,369,246 | 2/1921 | Jones | 16/172 |
| 2,207,923 | 7/1940 | Kelso | 182/156 |
| 2,230,015 | 1/1941 | Rich | 182/161 |
| 2,948,332 | 8/1960 | Hamilton | 297/60 |
| 3,059,722 | 10/1962 | Rouse | 182/156 |
| 3,227,243 | 1/1966 | Bates | 297/60 |
| 4,119,175 | 10/1978 | Herwynen | 182/125 |

FOREIGN PATENT DOCUMENTS

| | | | |
|---|---|---|---|
| 1103090 | 5/1955 | France | 182/125 |
| 666251 | 8/1964 | Italy | 182/125 |

*Primary Examiner*—Reinaldo P. Machado

*Attorney, Agent, or Firm*—Reising, Ethington, Barnard, Perry & Brooks

[57] ABSTRACT

An improved combined chair and stool apparatus is disclosed. The apparatus includes a U-shaped member having a pair of leg portions defining the front legs of the apparatus, a pair of spaced support members extending between the front legs and secured thereto, and a pair of folding steps comprising upper and lower steps. A pair of spaced back legs are pivotally connected to the top step adjacent to the back edge of the top step for relative pivotal movement therebetween. A pair of spaced pivot links are pivotally connected at their opposite ends to the upper support member and to the back portion of the upper step. The lower step is pivotally attached at its front portion to the lower support member. A second pair of pivot links are pivotally connected to the top step and the bottom step. The second pair of pivot links are connected to the top step at a position forward the pivotal connection between the top step and the first pair of pivot links. The back legs are pivotally connected to their respective front legs at the ends of the back legs.

6 Claims, 8 Drawing Figures

COMBINED CHAIR AND STOOL APPARATUS

TECHNICAL FIELD

This invention relates to foldable seats and in particular to foldable seats which may be locked in a folded position and a supporting position.

BACKGROUND ART

Prior patents disclosed foldable seats which can be used as a stool or as a step ladder or a combination of both. Examples of such combinations are disclosed in the U.S. Pat. Nos. of Kelso, 2,207,923; Rich, 2,230,015; and Rouse, 3,059,722. Typically, such combinations comprise at least two steps having a wide base for firm support when the combination is in a supporting position. Commonly, such combinations are of steel construction and have a baked enamel finish. The top seat is cushioned and has a vinyl covering for seating comfort. Such combinations may also have a curved seat back and tips on the ends of the supporting legs to protect the ends of the legs. The combinations are foldable so that when not in use the combinations may be stored in a relatively narrow space. Pivot links, which connect the seats to the main frame of the combination, commonly cause the seats to pivot in the same direction to obtain the desired folded storage position.

DISCLOSURE OF THE INVENTION

An object of the present invention is to provide an improved foldable chair and stool apparatus having a locked folded position and a supporting position.

Another object of the present invention is to provide a foldable seat having a pair of front legs, a pair of back legs, and interconnected top and bottom steps pivotally connected to the back and front legs, respectively, wherein as the seat is folded, the front portion of the top step pivots upwardly about its pivotal connection to the back legs and the back portion of the bottom step pivots upwardly about its pivotal connection to the front legs.

A further object of the present invention is to provide a combined chair and stool apparatus having a pair of front legs, a pair of rear legs, upper and lower support members extending between the front legs, upper and lower steps and a pair of spaced pivot links pivotally connected at their opposite ends to the upper support member and to the back portion of the upper step, the pivot links extending rearwardly from the upper support member, the upper support member supporting the upper step at its front portion in a supporting position wherein the apparatus also includes a second pair of spaced pivot links pivotally connected at one of their ends to the upper step at a position spaced away from the pivotal connection between the upper step and the first pair of pivot links toward the front portion of the upper step and pivotally connected at their opposite ends to the back portion of the lower step.

Yet another object of the present invention is to provide a combined chair and stool apparatus having a pair of front legs, a pair of back legs pivotally connected thereto, upper and lower support members extending between the front legs and upper and lower steps pivotally connected to the legs wherein the apparatus also includes a locking assembly operatively associated with the upper step for locking the apparatus in a supporting position to prevent inadvertent pivotal movement of the front legs with respect to the back legs.

In carrying out the above objects and other objects of this invention, a preferred embodiment of the combined chair and stool apparatus which has a locked, folded position and a supporting position includes a pair of front legs, upper and lower support members extending between the front legs and secured thereto, and a pair of planar steps comprising upper and lower steps. The steps have an upper support surface extending in a substantially horizontal direction in the support position and extending in an approximate vertical direction in the locking, folded position. The apparatus further includes a pair of spaced rigid pivot links pivotally connected at their opposite ends to the upper support member and to the back portion of the upper step, the pivot links extending rearwardly from the upper support member, the upper support member supporting the upper step at its front portion in a supporting position. The lower step is pivotally attached at its front portion to the lower support member. The apparatus also includes a pair of spaced back legs pivotally connected to the top step adjacent the back edge of the top step for relative pivotal movement therebetween and pivotally connected at their respective front legs above the pivotal connection between the upper step and the back legs in the supporting position. A second pair of spaced rigid pivot links are included and are pivotally connected at one of the ends to the upper step at a position spaced away from the pivotal connection between the upper step and the first pair of pivot links toward the front portion of the upper step and pivotally connected at their opposite ends to the back portion of the lower step. The second pair of links holds the apparatus at the lower step in the locked, folded position. The second pair of pivot links engage the upper step member to prevent the apparatus from moving out of the locked, folded position.

The objects, features and advantages of the present invention are readily apparent from the following detailed description of the best mode taken in connection with the accompanying drawings.

BEST MODE FOR CARRYING OUT THE INVENTION

Figure 1:
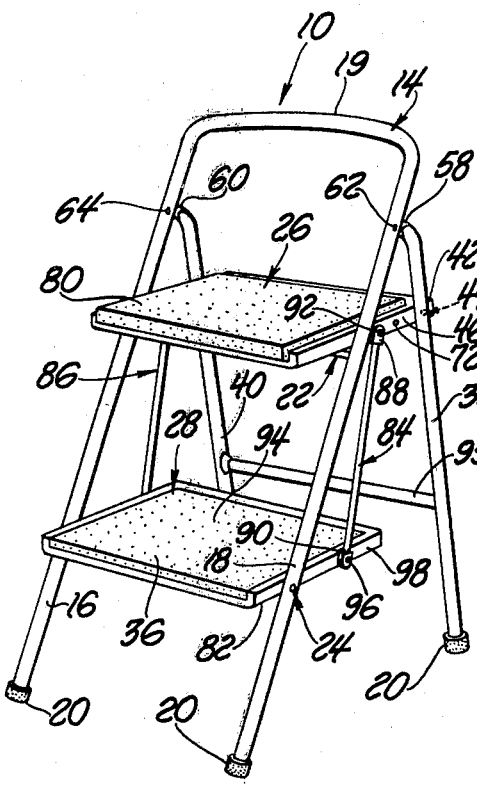
FIG. 1 is a perspective view which shows a combined chair and stool apparatus in a supporting position.

Referring now to the drawings, there is shown an illustrative embodiment of the invention in a combined chair and stool apparatus including a locking assembly especially adapted for climbing and seating purposes.

Figure 2:
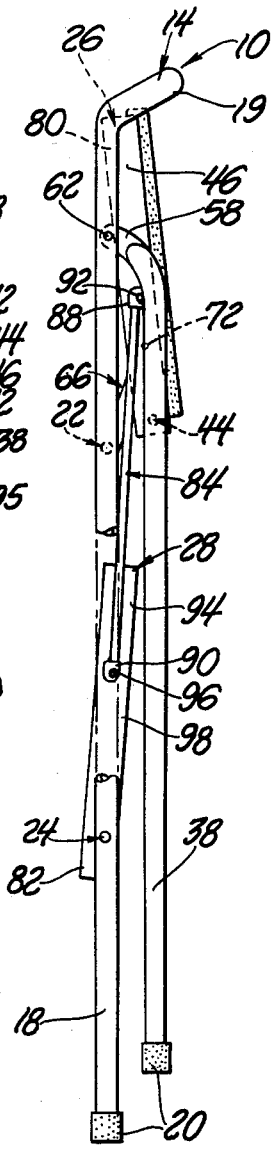
FIG. 2 is a side elevational view of the apparatus of FIG. 1 in its extrememost folded position.
Figure 3:
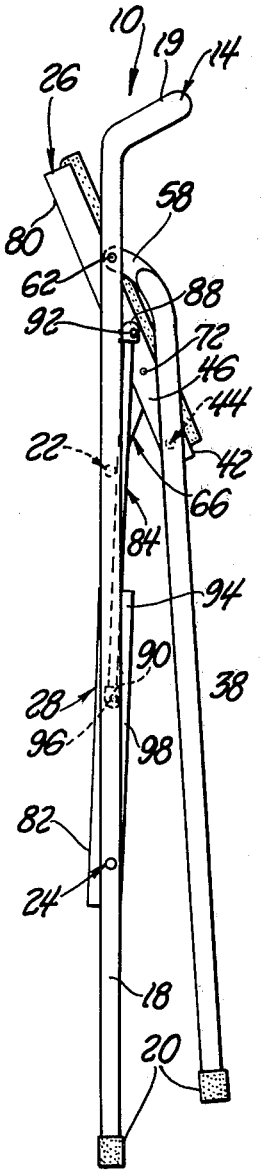
FIG. 3 is a side elevational view of the apparatus of FIG. 1 in a locked, folded position.
Figure 4:
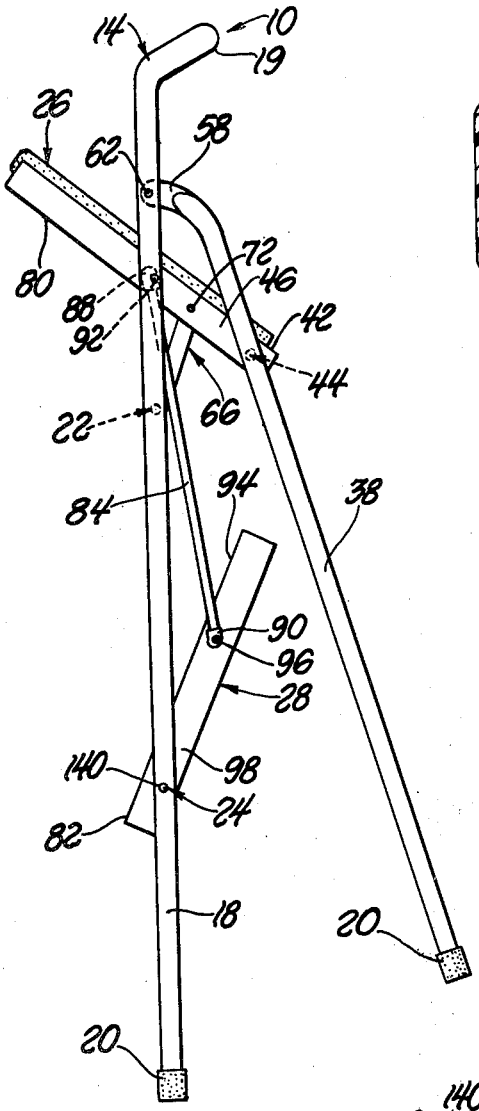
FIG. 4 is a side elevational view of the apparatus of FIG. 1 in an unlocked, partially folded position.
Figure 5:
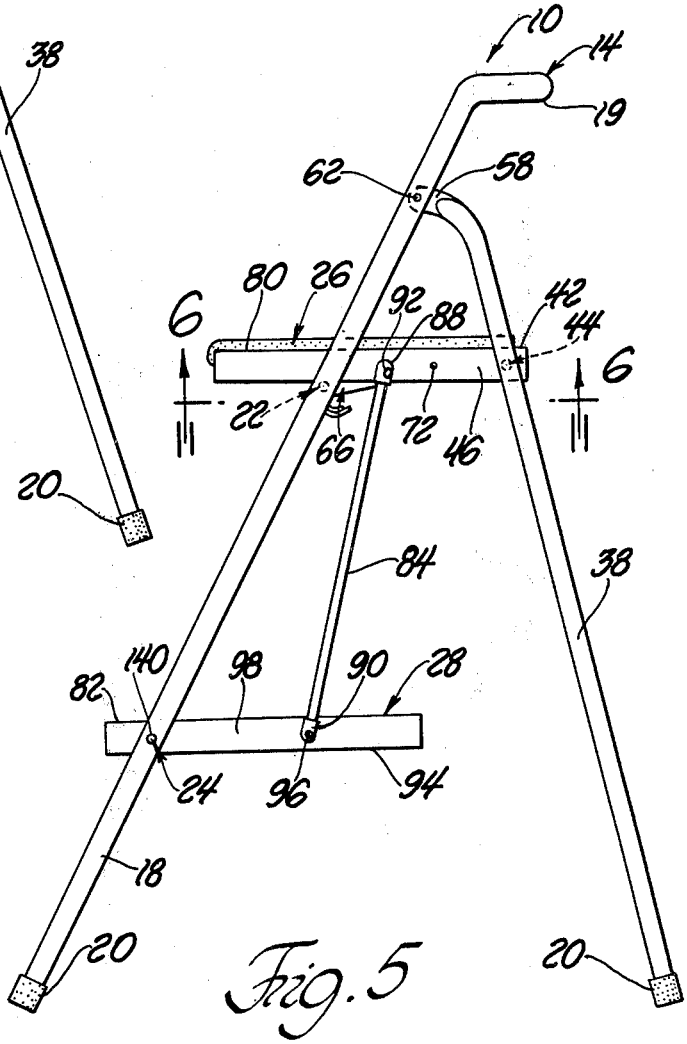
FIG. 5 is a side elevational view of the apparatus of FIG. 1 in the supporting position.

Referring to FIG. 1, the chair and stool apparatus is generally indicated at 10. The apparatus 10 has a range of folded positions as indicated in FIGS. 2, 3, and 4 and a supporting position as indicated in FIGS. 1 and 5. In FIGS. 2 and 3 the apparatus 10 is shown in locked, folded positions, while in FIG. 4 the apparatus 10 is shown in an unlocked, partially folded position. The apparatus 10 is locked in both of the supporting positions in FIGS. 1 and 5 by a locking assembly generally indicated at 12 in FIGS. 6 and 7.

With reference to FIG. 1, the apparatus 10 includes a U-shaped member generally indicated at 14 having a pair of metal legs comprising the front legs 16 and 18 of the apparatus 10. The U-shaped member 14 comprises a hollow drawn-steel tube having a baked enamel or chrome finish. Conventional rubber protector tips 20 are disposed on the ends of the front legs 16 and 18.

The apparatus 10 includes a pair of hollow, metal, rod-shaped support members. The support members are spaced apart and comprise an upper support member generally indicated at 22 in FIGS. 1 and 6, and a substantially identical lower support member 24. Both of the support members 22 and 24 extend between the front legs 16 and 18 and are fastened thereto, for example, by screws, rivets or other fasteners.

Figure 7A:
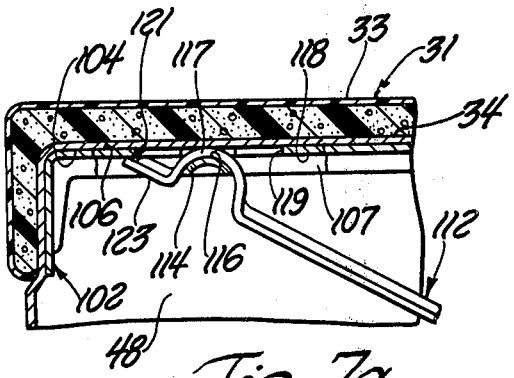
FIG. 7 is a sectional view of the apparatus taken along the line 7—7 of FIG. 6 partially broken away and slightly enlarged for illustrative purposes; and FIG. *7a* is a sectional, enlarged view of a portion of FIG. 7.
Figure 6:
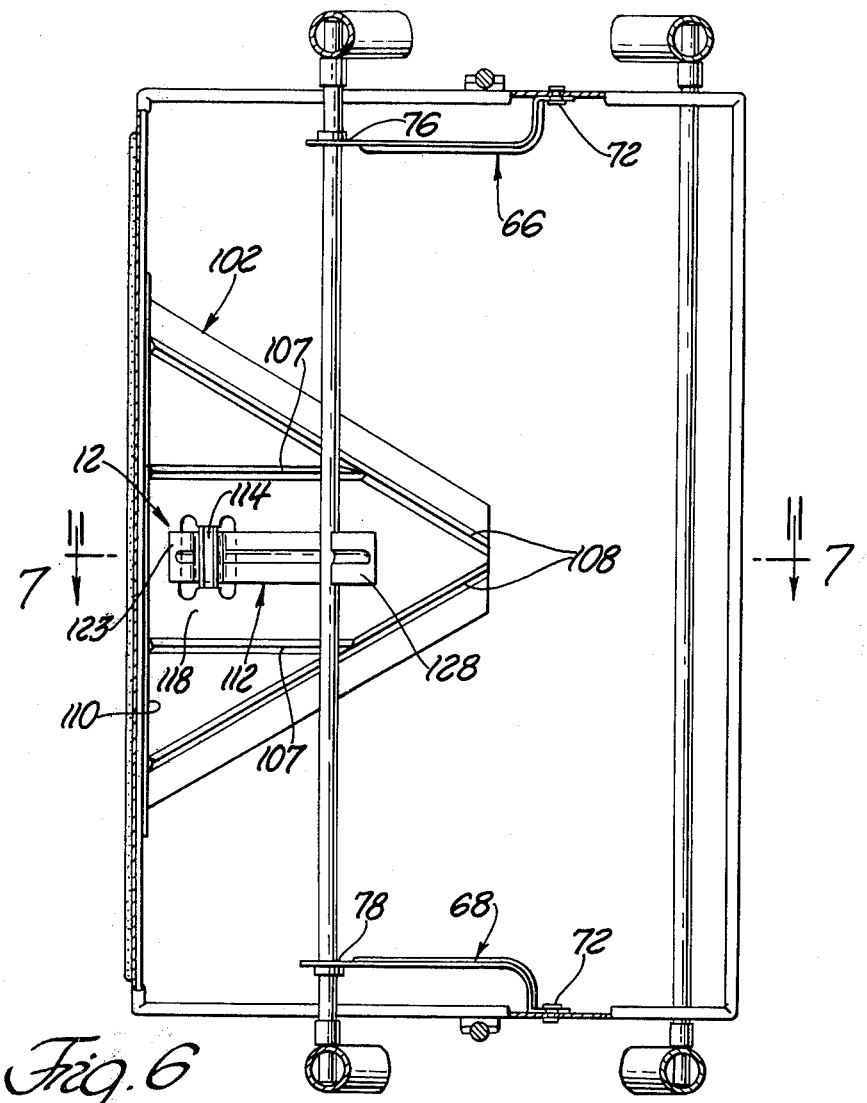
FIG. 6 is a sectional view of the apparatus taken along the line 6—6 of FIG. 5 partially broken away and slightly enlarged for illustrative purposes.
Figure 7:
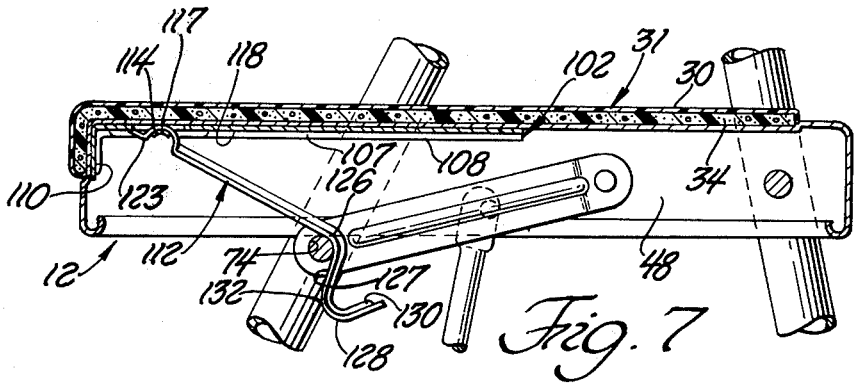

The apparatus 10 further includes a pair of spaced upper and lower planar steps generally indicated at 26 and 28, respectively. As shown in FIGS. 6 and 7, the upper step 26 comprises a substantially rectangular frame member generally indicated at 30 having an open bottom defined by an inwardly curved edge portion 32. The side and top surfaces of the frame member 30 are indented or depressed to accommodate a cushion or padding generally indicated at 31 having a vinyl covering 33. The padding 31 is positioned and held in a conventional fashion in a depression 34 such as with an adhesive.

The lower step 28 includes a vinyl covered steep plate 36 (FIG. 1) fixedly disposed in an indented or depressed portion of the lower step 28 similar to the depression 34 in the upper step 26.

The apparatus 10 also includes a pair of spaced, hollow metal back legs 38 and 40 which are pivotally connected to the top step 26 adjacent the back edge 42 of the top step 26 by a rigid bar generally indicated at 44 which extends the entire width of the top step 26 through side walls 46 and 48 of the top step 26 as shown in FIG. 6.

The back legs 38 and 40 are pivotally connected as shown in FIG. 6 to the bar 44 at its ends 50 and 52 which extend through the hollow back legs 38 and 40 by stud and collar members 54 and 56, respectively, on the bar 44 in a conventional fashion. The collar members 56 space the back legs 38 and 40 from the side walls 46 and 48 of the upper step 26 while the studs 54 allow the pivotal movement of the back legs 38 and 40 on and about the longitudinal axis of the bar 44 at its ends 50 and 52.

The back legs 38 and 40 are also pivotally connected to the front legs 18 and 16 respectively above the pivotal connection between the upper step 26 and the back legs 38 and 40 in the supporting position as shown in FIG. 1. As is best shown in FIG. 1, the back legs 38 and 40 include flanged end portions 58 and 60, respectively, for making the desired pivotal connection to the front legs 18 and 16 respectively. The hollow legs 18 and 16 are slotted to receive the flanged end portions 58 and 60 therein. The flanged portions 58 and 60 are pivotally connected within the slots of the front legs 18 and 16, respectively, by rivets 62 and 64 which extend through their corresponding end portions 58 and 60 and legs 16 and 18.

As best shown in FIGS. 6 and 7, the apparatus 10 also includes a pair of spaced, rigid, reinforced metal pivot links generally indicated at 66 and 68 which are pivotally connected to the side walls 46 and 48, respectively, at the back portion 70 of the upper step 26 by rivets 72 which extend through the end portions of the pivot links 66 and 68 and the side walls 46 and 48, respectively, of the upper step 26. The pivot links 66 and 68 are also pivotally connected to the upper support member 22 which extends through apertures 74 formed through the opposite end portions 76 and 78 of the pivot links 66 and 68, respectively. The pivot links 66 and 68 extend rearwardly from the upper support member 22. In the supporting position shown in FIG. 6 the upper support member 22 supports the upper step 26 at the front portion 80 of the upper step 26.

The lower step 28 is pivotally attached at its front portion 82 to the front legs 16 and 18 about the lower support member 24 in a conventional fashion.

The apparatus 10 also includes a second pair of spaced, rigid pivot links 84 and 86 which comprise hollow drawn-steel tubes having opposite ends terminating in upper and lower flange portions 88 and 90, respectively. The second pair of pivot links 84 and 86 are pivotally connected at their upper flange portions 88 to the side walls 46 and 48, respectively, of the upper step 26 such as by rivets 92 which extend through off-centered holes formed through the flange portions 88 and 90. The rivets 92 further extend through the side walls 46 and 48 to pivotally secure the second pair of pivot links 84 and 86 to the top step 26.

The second pair of pivot links 84 and 86 are also pivotally connected at their lower flange portions 90 to the back portion 94 of the lower step 28 by rivets 96 (only one of which is shown) and which extend through the off-centered holes formed through the flange portions 90 and the side walls 98 of the lower step 28 in the same fashion as upper flange portions 88 of the links 84 and 86 attached to the side walls 46 and 48 of the upper step 26.

The back legs 38 and 40 have attached to their bottom ends the leg protector tips 20 in the same fashion as the leg protector tips 20 are attached at the bottom ends of the front legs 16 and 18.

A horizontal support bar or brace 95 extends between the back legs 38 and 40 and is fixedly connected thereto at its opposite ends to the back legs 38 and 40 such as by welding to thereby provide structural strength between the back legs 38 and 40.

As is best shown in FIGS. 6 and 7, locking means or the locking assembly 12 is provided for locking the apparatus 10 in the supporting position and thereby prevents pivotal movement of the U-shaped member 14 and the upper step 26 with respect to the back legs 38 and 40.

The locking assembly 12 includes a trapezoidal, ribbed, metal support plate generally indicated at 102 fixedly mounted at the lower surface 104 of the top step 26 at its top surface 106 such as by welding. The plate 102 includes a pair of parallel, stamped, reinforcing, U-shaped ribs 107 and a pair of angled, stamped, reinforcing, V-shaped ribs 108. The plate 102 also includes an integral forward flange portion 110 which extends downwardly from the lower surface 104 of the upper step 26 and is immediately adjacent the inner surface of the front portion 35 of the upper step 26.

The locking assembly 12 also includes a locking member embodied by a broad, rigid, ribbed, metal hook generally indicated at 112 which is pivotally connected at its end portion to the support plate 102 by a curved, integrally formed flange 114 downwardly depending from the bottom surface 118 of the support plate 102. The flange 114 has a curved upper surface 116 (FIG. 7*a*) in which a complementary curved portion 117 of the hook 112 slidably mates to provide the pivotal connection therebetween. The curved portion 117 extends between a pair of apertures 119 and 121 separated by the flange 114 and terminates in an integrally formed stop member 123 which will be described in greater detail hereinafter.

As shown in FIG. 7, the hook 112 includes an integral, inwardly curved portion 126 curved away from the bottom surface 118 of the support plate 102 for engaging the upper support member 22 about its curved inner surface. The hook 112 also includes an integral second end portion 128 opposite the first pivotally connected end portion of the hook 112. The second end portion 128 is curved outwardly towards the bottom surface 118 of the support plate 112 and has an inner concave surface 130 and an outer convex surface 132, the outer convex surface 132 extending below the upper support member 22 in the locked supporting position.

The stop member 123 limits the pivotal movement of the hook 112 about the flange 114 by engaging the lower surface 118 of the support plate 102 at its extrememost downward position to thereby allow the hook 112 to engage the upper support member 22 during the downward pivotal movement of the upper step 26 towards the upper support member 22. In other words, as the upper step 26 moves downwardly the curved portion 126 of the hook 112 engages the upper support member 22 and thereafter the hook 112 may lockingly engage the upper support member 22 by sliding along the inner curved portion 127 of the inwardly curved portion 126 until it moves into its locking position.

The apparatus 10 is moved out of its supporting position as shown in FIG. 5 and into one of its folded positions as shown in FIG. 4 by first unlatching the hook 112 from the upper support member 22 by applying a force against the outer convex surface 132 of the end portion 128 until the hook 112 disengages the support member 22. Thereafter, as the apparatus 10 is folded from the supporting position through a range of folded positions including a position as shown in FIG. 4, the front legs 16 and 18 pivotally move toward the back legs 38 and 40. The front portion 80 of the upper step 26 pivots upwardly about the bar 44 as do the rivets 72. The back portion 94 of the lower step 28 rotates upwardly about the lower support member 24 as the second pair of pivot links 84 and 86 pull the lower step 28 upwardly until the apparatus 10 is in its foldedmost position as shown in FIG. 2. When the apparatus is in the position as shown in FIG. 2, the second pair of links 84 and 86 are in a slightly angled, overcenter position with respect to the plane of the lower step 28. In other words, the center of the rivet 96 is slightly forward of a straight line (not shown) drawn between the pivotal connection 24 (between the lower step 28 and the front leg 18) and the center of the rivet 92 so as to hold the apparatus 10 in a locked, folded position.

An attempt to pivotally move the apparatus 10 out of the position shown in FIG. 2 towards the position shown in FIG. 4 causes the second pair of pivot links 84 and 86 to engage the upper support member 22 as shown in FIG. 3. The pivot links 84 and 86 engage the member 32 between the front legs 16 and 18 and the upper step 26 at collar members 136 and 138 of the upper support member 22, which are best seen in FIG. 6. As a result, the folded positons as shown in FIGS. 2 and 3 define the extrememost positions of a range of locked, folded positions in which the apparatus 10 is locked in a folded position.

To allow the apparatus 10 to move out of its folded, locked position, it is necessary to apply a force at the back portion 94 of the lower step 28 to disengage the second pair of pivot links 84 and 86 from the collars 136 and 138 and at the same time move the lower step 28 out of its overcenter position. In this way the apparatus 10 can move to its unlocked, folded position as shown in FIG. 4 and subsequently back into its supporting position as shown in FIGS. 1, 5, 6 and 7.

While the preferred embodiment of a combined chair and stool apparatus including a locking assembly has been shown and described herein in detail, those skilled in this art will recognize various alternative designs and embodiments for practicing the present invention as defined by the following claims.

What is claimed is:

1. A combination chair and stool apparatus having a folded position and a supporting position, said apparatus comprising:

a pair of front legs;

upper and lower support members extending between the front legs and secured thereto;

a pair of planar steps comprising upper and lower steps, each of said steps having an upper support surface extending in a substantially horizontal direction in the supporting position and extending in an approximately vertical direction in the folded position;

a pair of spaced, rigid pivot links pivotally connected at their opposite ends to said upper support member and to the back portion of said upper step, the pivot links extending rearwardly from said upper support member, the upper support member supporting said upper step at its front portion in said supporting position, the lower step being pivotally attached at its front portion to said lower support member;

a pair of spaced back legs pivotally connected to said top step adjacent the back edge of the top step for relative pivotal movement therebetween and pivotally connected to their respective front legs above the pivotal connection between said upper step and said back legs;

a second pair of spaced, rigid pivot links pivotally connected at one of their ends to said upper step at a position spaced away from said pivotal connection between said upper step and said first pair of pivot links toward the front portion of said upper step and pivotally connected at their opposite ends to the back portion of said lower step, wherein said second pair of links holds the step of the apparatus in the supporting position thereof, wherein said second pair of pivot links engage said upper support member in the folded position, and wherein the pivotal connection of the second pair of links to the lower step moves forward of a line between the pivotal connection of the lower step to the front legs and the pivotal connection of the second pair of links to the upper step upon movement of the apparatus to the folded position to thereby provide overcenter locking thereof with the second pair of links engaging the upper support member between the front legs; and a locking means including a locking member having a locking position where the locking member extends between said upper step and said upper support member to provide locking of said apparatus in said supporting position to prevent said pivotal movement of said front legs with respect to said back legs.

2. A combination chair and stool apparatus having a folded position and a supporting position, said apparatus comprising:

a pair of front legs;

upper and lower support members extending between the front legs and secured thereto;

a pair of planar steps comprising upper and lower steps, each of said steps having an upper support surface extending in a substantially horizontal direction in the supporting position and extending in an approximately vertical direction in the folded position;

a pair of spaced, rigid pivot links pivotally connected at their opposite ends to said upper support member and to the back portion of said upper step, the pivot links extending rearwardly from said upper support member, the upper support member supporting said upper step at its front portion in said supporting position, the lower step being pivotally attached at its front portion to said lower support member;

a pair of spaced back legs pivotally connected to said top step adjacent the back edge of the top step for relative pivotal movement therebetween and pivotally connected to their respective front legs above the pivotal connection between said upper step and said back legs;

a second pair of spaced, rigid pivot links pivotally connected at one of their ends to said upper step at a position spaced away from said pivotal connection between said upper step and said first pair of pivot links toward the front portion of said upper step and pivotally connected at their opposite ends to the back portion of said lower step, wherein said second pair of links holds the step of the apparatus in the supporting position thereof, wherein said second pair of pivot links engage said upper support member in the folded position;

a locking means including a locking member having a locking position where the locking member extends between said upper step and said upper support member to provide locking of said apparatus in said supporting position to prevent said pivotal movement of said front legs with respect to said back legs, said locking means also including a support plate fixedly mounted at the lower surface of the upper step, said locking member comprising a broad rigid hook having first end portion and a pivotal connection to the support plate approximately midway between said front legs for holding the upper support member in locking relationship with respect to said upper step, and the first end portion of said hook including an integrally connected stop member to limit said pivotal movement of said hook by engaging said support plate to allow said hook to engage said upper support member during the downward pivotal movement of said upper step toward said upper support member.

3. The apparatus as claimed in claim 2 wherein said support plate has a pair of apertures spaced apart by an integral flange downwardly depending from the bottom surface of said support plate and wherein said hook extends through said apertures and is pivotally connected to said support plate at said flange.

4. The apparatus as claimed in claim 3 wherein said flange has a curved portion and wherein said first end portion of said hook includes a complementary curved portion to mate with the curved portion of the flange, said complementary curved portion extending through said apertures for providing said pivotal connection between said hook and said support plate.

5. The apparatus as claimed in claim 2 wherein said hook includes an inwardly bent portion bent away from the bottom surface of said support plate to lockingly engage said upper support member at the inner surface of the bent portion.

6. The apparatus as claimed in claim 5 wherein said hook includes a second end portion opposite the first end portion integrally connected to said inwardly bent portion, said second end portion being bent outwardly toward the bottom surface of the support plate and defining an inner concave surface and an outer convex surface, said outer convex surface extending below said upper support member in said supporting position.

* * * * *